US009988846B2

(12) United States Patent
Gonzalez

(10) Patent No.: US 9,988,846 B2
(45) Date of Patent: Jun. 5, 2018

(54) GAUGE FOR BENT HOUSING MOTOR DRILL BIT

(71) Applicant: National Oilwell DHT, L.P., Houston, TX (US)

(72) Inventor: Israel Gonzalez, Conroe, TX (US)

(73) Assignee: National Oilwell DHT, L.P., Houston, TX (US)

( * ) Notice: Subject to any disclaimer, the term of this patent is extended or adjusted under 35 U.S.C. 154(b) by 314 days.

(21) Appl. No.: 14/963,983

(22) Filed: Dec. 9, 2015

(65) Prior Publication Data

US 2016/0168914 A1 Jun. 16, 2016

Related U.S. Application Data

(60) Provisional application No. 62/090,275, filed on Dec. 10, 2014.

(51) Int. Cl.

| | |
|---|---|
| ***E21B 7/06*** | (2006.01) |
| ***E21B 10/43*** | (2006.01) |
| ***E21B 17/10*** | (2006.01) |
| ***E21B 10/42*** | (2006.01) |

(52) U.S. Cl.
CPC ..... *E21B 7/064* (2013.01); *E21B 10/42* (2013.01); *E21B 10/43* (2013.01); *E21B 17/1092* (2013.01)

(58) Field of Classification Search
CPC ..... G06F 17/50; G06F 17/5009; E21B 7/064; E21B 10/43; E21B 17/1092; E21B 10/42
USPC ..... 703/2, 3, 10; 175/74
See application file for complete search history.

(56) References Cited

U.S. PATENT DOCUMENTS

| | | | | |
|---|---|---|---|---|
| 4,838,366 | A | 7/1989 | Jones | |
| 5,967,247 | A * | 10/1999 | Pessier | E21B 7/064 175/406 |
| 6,092,610 | A * | 7/2000 | Kosmala | E21B 4/20 175/27 |
| 6,394,200 | B1 | 5/2002 | Watson et al. | |
| 7,318,492 | B2 * | 1/2008 | Watson | E21B 7/064 175/336 |
| 8,386,181 | B2 * | 2/2013 | Propes | E21B 44/00 175/40 |
| 2009/0229888 | A1 * | 9/2009 | Chen | E21B 10/00 175/426 |
| 2010/0270077 | A1 | 10/2010 | Huynh et al. | |

FOREIGN PATENT DOCUMENTS

| | | | |
|---|---|---|---|
| GB | 2462813 | A | 2/2010 |

* cited by examiner

*Primary Examiner* — Michael R Wills, III
(74) *Attorney, Agent, or Firm* — Jonathan M. Pierce; Porter Hedges LLP

(57) ABSTRACT

A drilling assembly comprises a bit body having a central axis and a blade extending radially outward from the bit body. The blade is defined by a leading edge and a trailing edge. A gauge surface extends from the leading edge to a surface break and may be disposed at a gauge diameter from the central axis. A recessed surface extends from the surface break to the trailing edge. The recessed surface may be configured to avoid contact between the trailing edge and the wellbore wall.

19 Claims, 5 Drawing Sheets

GAUGE FOR BENT HOUSING MOTOR DRILL BIT

CROSS-REFERENCE TO RELATED APPLICATIONS

This application claims priority to U.S. Provisional Application Ser. No. 62/090,275 filed on Dec. 10, 2014, and entitled "Gauge for Bent Housing Motor Drill Bit". The priority application is incorporated herein by reference.

BACKGROUND

This disclosure relates generally to methods and apparatus for drilling wellbores. More specifically, this disclosure relates to drill bits for use in drilling wellbores. Still more specifically, this disclosure relates to drill bits for use with bent housing motors.

In drilling a wellbore, such as for the recovery of hydrocarbons or minerals from a subsurface formation, it is conventional practice to connect a drill bit onto the lower end of a drill string. The drill bit is then rotated to form the wellbore. During drilling, a drilling fluid is pumped through the drill string to the drill bit. The drilling fluid passes through nozzles or orifices in the drill bit, into the wellbore, and then upward back to the surface through the annular space between the drill string and the wellbore. The drilling fluid serves to carry wellbore cuttings to the surface as well as clean and cool the drill bit.

In certain drilling operations, a downhole motor is incorporated into the drill string above the drill bit. The downhole motor utilizes the drilling fluid being pumped through the drill string to rotate the drill bit. Downhole motors are often used to increase the rotation speed of the drill bit and expedite drilling. In some operations, the downhole motor may be combined with a bent sub or bent housing that serves to tilt the drill bit at an angle from the centerline of the drill string. This tilt can be useful in changing and/or controlling the trajectory of the wellbore.

As the drill string is rotated, this tilt angle causes the central axis of the drill bit to rotate about an axis that is tilted relative to the bottom of the wellbore and/or relative to the wellbore trajectory. The cutters on the drill bit may sometimes not rotate about a fixed axis in the wellbore and are therefore not always in full contact with the wellbore as they would be during conventional drilling. Thus, there is a continuing need in the art for methods and apparatus for providing drill bits specially designed to work with bent motor housings or bent subs.

BRIEF SUMMARY OF THE DISCLOSURE

In one or more aspects, a drilling assembly comprises a bit body coupled to a power section. The bit body has a central axis, a gauge diameter measured relative to the central axis, and a bit diameter measured relative to the central axis. The bit diameter is larger than the gauge diameter. The drilling assembly further comprises a first blade extending radially outward from the bit body to the gauge diameter. The first blade is defined by a leading edge and a trailing edge. The drilling assembly further comprises a second blade adjacent the first blade. The second blade extends radially outward from the bit body to the gauge diameter. The drilling assembly further comprises a first cutter secured to the first blade. The first cutter extends radially to the bit diameter, and has a first cutting face that intersects the gauge diameter at a first point. The drilling assembly further comprises a second cutter secured to the second blade. The second cutter has a second cutting face that extends radially between an innermost second point of the second cutting face and the bit diameter. The drilling assembly further comprises a gauge surface extending from the leading edge of the first blade to a surface break, and a recessed surface extending from the surface break to the trailing edge of the first blade. The surface break is disposed at the gauge diameter, and the trailing edge is partially located on or within a circle. The circle passes through the first point and the second point, and is tangent to the bit diameter. A distance from the central axis to the recessed surface may decrease in a linear manner from the surface break to the trailing edge. A distance from the central axis to the recessed surface may decrease in a non-linear manner from the surface break to the trailing edge. The gauge surface may be at the gauge diameter. The power section may have a bent housing. The gauge surface and the recessed surface may be configured so that the gauge surface provides full gauge contact when the drilling assembly is sliding through a wellbore and to minimize contact between the trailing edge and the wellbore when the bit body is being rotated by the power section.

In one or more aspects, a drilling assembly comprises a power section coupled to a drill string. The power section includes a bent housing. The drilling assembly further comprises a bit body coupled to the power section and having a central axis, a blade extending radially outward from the bit body and defined by a leading edge and a trailing edge, and a gauge surface extending from the leading edge to a surface break. The gauge surface is disposed at a gauge diameter from the central axis. The drilling assembly further comprises a recessed surface extending from the surface break to the trailing edge. The recessed surface is configured by determining a range of motion in which cutters on the leading edge are in contact with a wellbore wall, determining the interference between the trailing edge of the blade and the wellbore wall outside of the determined range of motion, and determining the dimensions of the recessed surface necessary to avoid contact between the trailing edge and the wellbore wall outside of the determined range of motion. The gauge surface and the recessed surface may be configured so that the gauge surface provides full gauge contact when the drilling assembly is sliding through a wellbore and to minimize contact between the trailing edge and the wellbore when the bit body is being rotated by the power section. A distance from the central axis to the recessed surface may decrease in a linear manner from the surface break to the trailing edge. A distance from the central axis to the recessed surface may decrease in a non-linear manner from the surface break to the trailing edge. The surface break may be at the gauge diameter. The drilling assembly may further comprise a cutter disposed on the blade at the gauge diameter.

In one or more aspects, a method of designing a drill bit comprises selecting a bottom hole assembly including a drill bit having a blade and a bent housing having a bend angle. The blade extends radially outward from the drill bit and is defined by a leading edge and a trailing edge and having cutters attached to the leading edge. The method further comprises selecting a set of drill parameters including a wellbore having a wellbore wall, evaluating the bottom hole assembly and the set of drill parameters to determine a range of contact for the drill bit, simulating the movement of the drill bit within the wellbore to determine if the blade contacts the wellbore wall outside of the range of motion, configuring a gauge surface extending from the leading edge to a surface break, and configuring a recessed surface extending from the surface break to the trailing edge. The gauge surface and the recessed surface are configured so that the gauge surface provides contact between the blade and the wellbore wall when the drill bit is sliding through the wellbore and minimizes contact between the trailing edge and the wellbore wall when the drill bit is being rotated. The range of contact may be determined using the bend angle of the bent housing. The movement of the drill bit may be simulated using the rotational speed of the drill bit and the rotational speed of the bottom hole assembly. A distance from a central axis of the drill bit to the recessed surface may decrease in a linear manner from the surface break to the trailing edge. A distance from a central axis of the drill bit to the recessed surface may decrease in a non-linear manner from the surface break to the trailing edge. The surface break may be at the same diameter as the leading edge. The drill bit may further comprise a cutter disposed on the leading edge of the blade.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
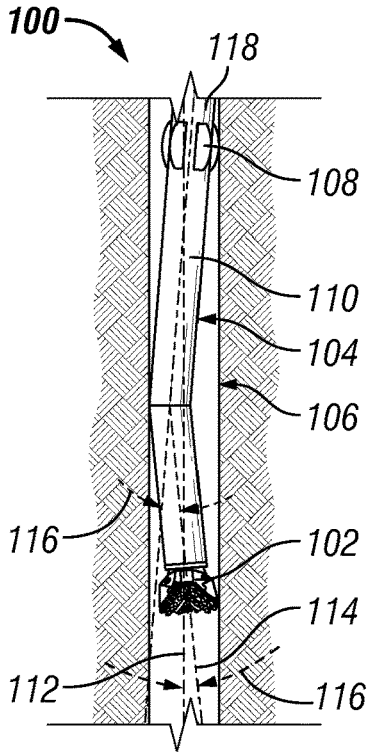
FIG. 1 is a partial sectional schematic of a drilling assembly including a bent motor housing.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a drilling assembly 100 includes a drill bit 102, a power section 110 having a bent housing 104, and a stabilizer 108. The drilling assembly 100 is disposed on a drill string 118 in a wellbore 106 having a central axis 112. The drill bit 102 is coupled to the power section 110 below the bent housing 104. The drill bit 102 may be a fixed cutter design, such as a polycrystalline diamond compact ("PDC") bit. Stabilizer 108 is disposed above the power section 110. Additional stabilizers may be located at other positions (e.g., a near bit stabilizer).

The bent housing 104 includes a bend angle that causes the central axis 114 of the drill bit 102 to incline away from the central axis 112 of the wellbore 106 as shown at 116. Although the deflection of the bent housing 104 is exaggerated for purposes of illustration, in practice, a bend angle of 2°-2.5° in the bent housing may be considered significant.

The power section 110 contains a downhole motor driven by the flow of pressurized drilling fluid through the drill string. In some embodiments, the power section 110 includes a positive displacement motor that produces rotational motion for driving the drill bit 102. Wellbore direction may be changed by rotating the drill bit 102, via the power section 110, while the bent housing 104 is prevented from rotating. Wellbore direction may be maintained by rotating both the drill bit 102 and the bent housing 104. The bent housing 104 may be rotated from the surface by rotational motion imparted to the drill string 118, while the drill bit 102 is driven by the power section 110.

To keep the trajectory of the wellbore 106 substantially straight while drilling with the bent housing 104, the bent housing may be continuously rotated by rotating the drill string 118 at surface, essentially cancelling out the trajectory changes induced by the bent housing 104. This mode of operation of the drilling assembly 100 is usually referred to as drilling in rotating mode. By providing blades of the drill bit 102 with surfaces recessed within a gauge diameter as described herein, contact between the trailing edge of the bit blades and the wellbore wall may be minimized or avoided during drilling in rotating mode.

Figure 2:
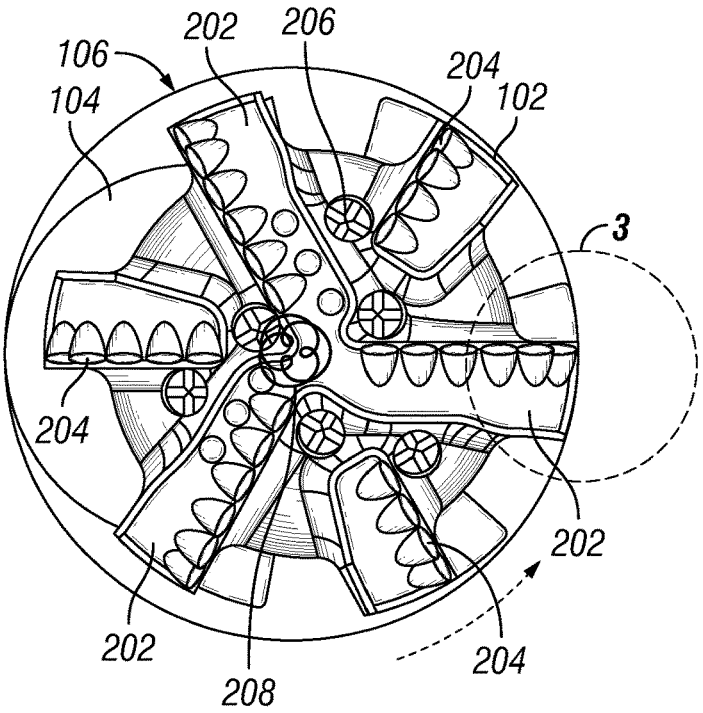
FIG. 2 is a bottom view of the drilling assembly of FIG. 1.

Referring now to FIG. 2, the drill bit 102 includes a plurality of blades 202 extending from the bit body, and each blade 202 includes a plurality of cutters 204. The cutters 204 scrape rock from the formations being drilled as the drill bit 102 rotates in the wellbore 106. The bit 102 also includes orifices 206 through which drilling fluid exits into the wellbore 106.

FIG. 2 shows a bottom view of the drill bit 102 and an exemplary rotational path 208 traveled by an exemplary cutter 204 or other selected point on the drill bit 102. The calculation of rotational path 208 may be determined by the methods described in U.S. Pat. No. 8,386,181, which is hereby incorporated by reference herein for all purposes. Although the rotational path 208 appears in FIG. 2 as a path in a single plane, it will be understood that as the bit 102 progresses deeper into a formation being drilled, the path of the bit also includes a component of longitudinal motion (i.e., in a Z direction, where the figure is in the X-Y plane).

The rotational path 208 illustrates the complex path traveled by the cutter 204 as the bent housing 104 rotates, via rotation of the drill string 118, and the drill bit 102 rotates independently from the bent housing 104 (i.e., driven by the power section 110) in the wellbore 106. Each cutter 204 travels a different path determined by the rotational speeds of the bent housing 104 and the drill bit 102, and the dimensional parameters of the bent housing 104, the drill bit 102, the location of stabilizer 108 and the wellbore 106.

Figure 3:
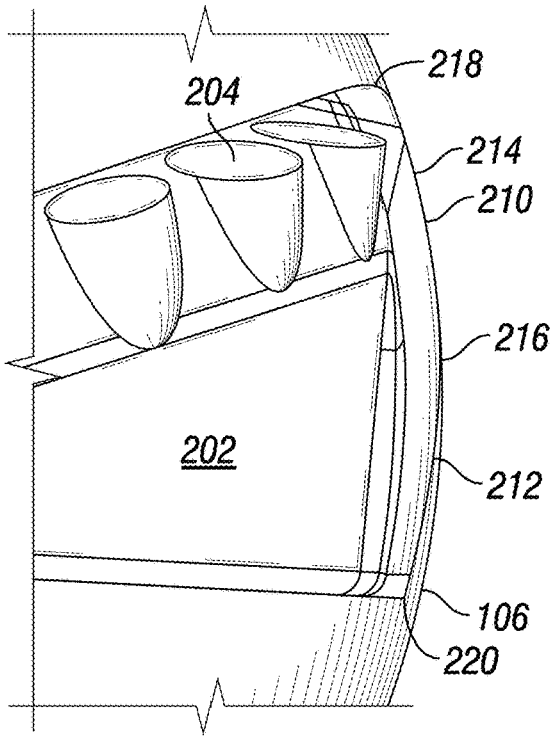
FIG. 3 is a detail view of a portion of FIG. 2.
Figure 4:
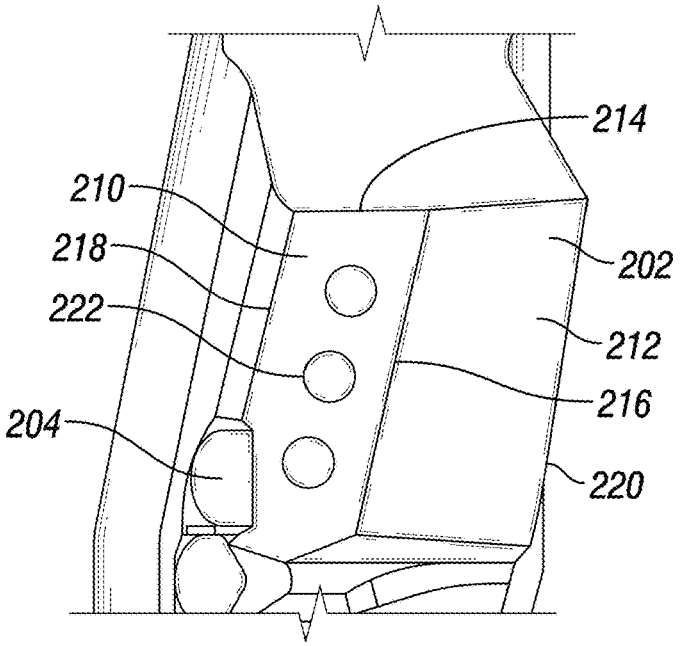
FIG. 4 is a partial elevation view of the drill bit of FIG. 1.

Referring now to FIGS. 3 and 4, each blade 202 includes an outer surface 214 defined by a leading edge 218 and a trailing edge 220. The outer surface 214 has a gauge surface 210 that extends from the leading edge 218 to a surface break 216 and a recessed surface 212 that extends from the surface break 216 to the trailing edge 220. As can be seen in FIG. 4, the gauge surface 210 and recessed surface 212 both extend upward along the blade 202. As used herein, a surface break is an interruption in continuity of a trend of the distance between the outer surface 214 from the central axis 114 of the drill bit 102 when moving from the leading edge 218 and the trailing edge 220 of the outer surface 214. As shown in the examples of FIGS. 3 and 4, the surface break 216 may include an edge between the gauge surface 210 and the recessed surface 212. However, in other examples, the surface break may not be angular and may include a crest line separating the gauge surface from the recessed surface.

The surface break 216 is disposed at a gauge diameter from the central axis 114 of the drill bit 102. In certain embodiments, the leading edge 218 and the gauge surface 210 may also be disposed at the gauge diameter. The recessed surface 212 is disposed at a distance from the central axis 114 that gradually decreases from the surface break 216 to the trailing edge 220, which is disposed at a distance less than the gauge diameter from the central axis 114. In certain embodiments, the distance of the recessed surface 212 from the central axis 114 may decrease in a linear manner or in a non-linear manner from the surface break 216 to the trailing edge 220.

The outer surface 214 may optionally comprise multiple materials having different properties such as different wear resistance. For example, the gauge surface 210 may include abrasion resistant inserts 222 (e.g., PDC inserts) that are mounted flush with the surface 210. The inserts 22 may be used to maintain the shape of the gauge surface 210 in an abrasive environment, that is, to maintain the distance from the central axis 114 close the its value when the drill bit 102 was made. The recessed surface 212 may be covered with a layer of sacrificial material selected to wear down during the drilling process upon contact between the trailing edge and the wellbore wall. In general, the outer surface may optionally include a plurality of inserts disposed at varying distances from the central axis 114 of the drill bit 102. In some cases, the insert axis may be oriented perpendicular to the outer surface 214, or may be skewed.

Drilling assembly 100 can be operated in a sliding mode where the drill bit 102 is being rotated by the power section 110 but the drill string 118 is not being rotated and in a rotating mode where the drill bit 102 is being rotated by the power section 110 and the drill string 118 is being rotated. As will be illustrated in FIGS. 5A-5C, the gauge surface 210 and the recessed surface 212 are configured so that the gauge surface 210 provides full gauge contact when the drilling assembly 100 is in the sliding mode and to minimize contact between the trailing edge 220 and the wellbore 106 when the drilling assembly 100 is in the rotating mode.

Figure 5A:
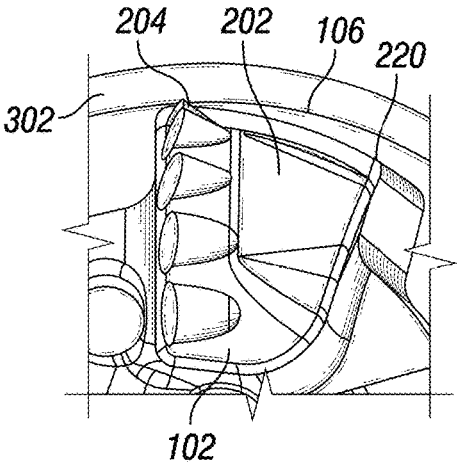
FIGS. 5A-5C are partial bottom views illustrating the sequence of a drill bit contacting the wellbore.
Figure 5B:
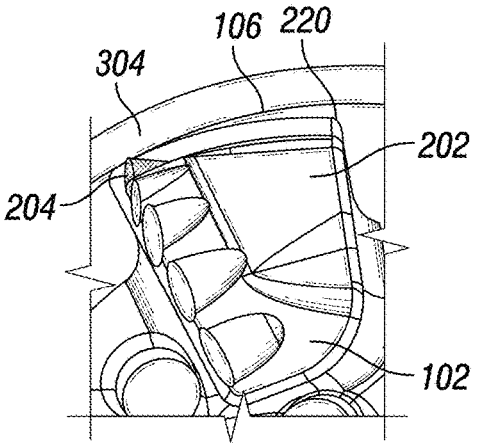
Figure 5C:
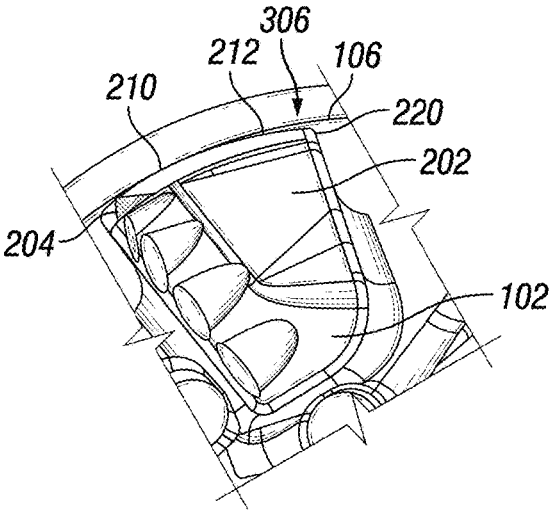

Referring now to FIGS. 5A-5C, the rotation of the drill bit 102 in the wellbore 106 in the rotating mode is illustrated. In the position shown in FIG. 5A, blade 202 is rotating counterclockwise in a bottom view (or clockwise in a top view) and cutter 204 is approaching, but not yet in contact with wall of the wellbore 106 at point 302. In FIG. 5B, cutter 204 is in contact with and is cutting the wall of the wellbore 106 at point 304. In this position, gauge surface 210 is also partially in contact with the wall of the wellbore 106. The contact between the gauge surface 210 and the wellbore 106 helps to stabilize the drill bit 102 within the wellbore 106.

Referring now to FIG. 5C, as the drill bit 102 continues to rotate, the cutter 204 moves away from the wall of the wellbore 106 but a portion of the gauge surface 210 remains in contact with the wall of the wellbore 106. The rotational path of the drill bit 102 pushes the trailing edge 220 toward the well of the wellbore 106 at point 306. The recessed surface 212 allows a portion of the gauge surface 210 to remain in contact with the wall of the wellbore 106 as the cutter 204 moves away from the wall of the wellbore 106. Thus, recessed surface 212 allows the drill bit 102 to smoothly rotate while maintaining contact with the wall of the wellbore 106. Without recessed surface 212, the trailing edge 220 of the blade 202 would tend to impact the wall of the wellbore 106 and push the drill bit 102 away from the wall of the wellbore 106. The impact of the trailing edge of the blade 202 may alter the rotational motion of the drill bit 102 and make drilling a uniform wellbore difficult.

Figure 6A:
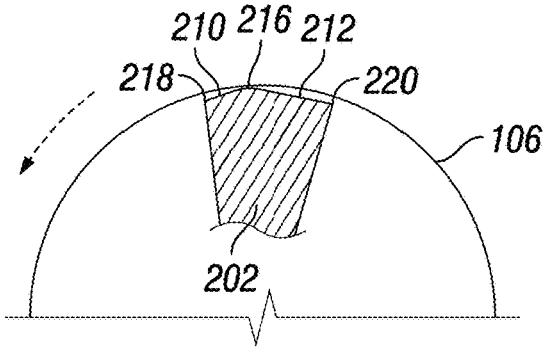
FIGS. 6A-6C are partial sectional views of drill bit blades.
Figure 6B:
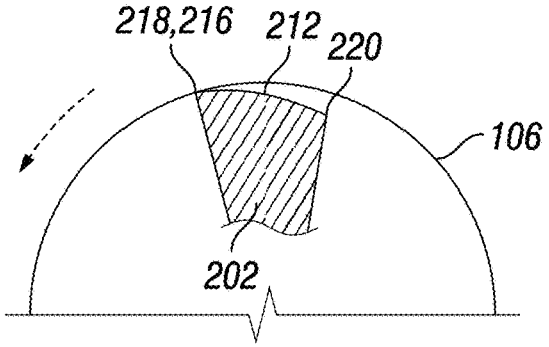
Figure 6C:
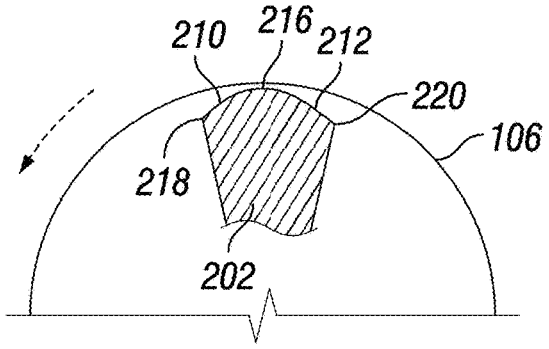

Referring now to FIGS. 6A-6C, example embodiments of gauge surface 210 and recessed surface 212 separated by surface break 216 are shown in sectional view of example blades 202 shown in a wellbore 106. In FIG. 6A, both the gauge surface 210 and recessed surface 212 are flat surfaces, and the surface break 216 is a straight edge between the gauge surface 210 and recessed surface 212. In FIG. 6B, the extent of the gauge surface 210 is minimal. In this example, the surface break 216 is adjacent to the leading edge 218 of the blade 202. The section of the recessed surface 212 is elliptic. In FIG. 6C, the surface break 216 is a smooth crest line between the gauge surface 210 and the recessed surface 212. Both the gauge surface 210 and the recessed surface 212 are located at a distance that is less than the gauge diameter from the central axis of the drill bit.

Drill bits having the features described herein may be designed using a method including the steps including (1) selecting a drill bit and bottom hole assembly (BHA); (2) determining the range of motion in which the cutters of a blade are in contact with the wellbore wall; (3) modeling the wellbore and BHA to determine if any portion of the blade is in contact with the wellbore wall outside of the determined range of motion and the amount of interference between the blade and the wellbore wall; and (4) determining the dimensions of a recessed surface to be formed on the blade to avoid contact outside of the determined range of motion.

In certain embodiments, the first step of designing a drill bit may include inputting drill parameters and information concerning the drill bit and other BHA components into a computer program known as a BHA calculator such as REEDHYCALOG®'s SYSTEMMATCHER™. The BHA calculator will evaluate the performance of the BHA at the entered drill parameters. The drill parameters may include the well diameter, well profile, formation lithology, drive type, rate of rotation, rate of penetration, and other relevant information concerning the drilling rig and the wellbore to be drilled. Information concerning the BHA may include identification of the specific components of the BHA, including the drill bit, motor, bent sub, and other relevant information concerning the BHA.

As part of evaluating the BHA, the BHA calculator will also generate geometric information regarding contact of the drill bit with the wellbore wall. In general the BHA Calculator will calculate three points of contact between the BHA and the wellbore wall, namely a bit contact point, or front point, a middle point, and a rear point. The middle point may be an adjusting ring or the front of a near-bit stabilizer. The rear point may be the end of the rear stabilizer or, if no rear stabilizer is used, the end of the top sub. Based on the input geometry and other information, the BHA calculator will generate an effective bit tilt, a bit offset, and a crossover length. The effective bit tilt being the orientation of the bit axis with respect to the wellbore axis, the bit offset being the eccentricity of the bit center from the wellbore axis. The crossover length being the distance from the front of the bit and the crossover point of the bit axis and the wellbore axis. This information can be extracted to determine a range of contact, in degree rotation of the drill string, in which a blade of the drill bit will be in contact with, and cutting, the wellbore wall. For example, the range of contact of a particular blade may be determined to be from 0° to 15° of drill string rotation.

A three-dimensional model of the BHA disposed within wellbore can then be built to analyze the behavior of the BHA within the wellbore. For example, the movement of the drill bit can be simulated to determine if the trailing edges of the blades contact the wellbore wall outside of the range of motion in which the cutters are engaged with the wellbore wall. In certain embodiments, the trajectories of selected points on the drill bit can be traced during rotation of the BHA and drill bit. Analyzing the trajectory of a point on the trailing edge of a blade can indicate the extent of the interference between the trailing edge and the wellbore wall, which can then be used to determine the dimensions of a recessed surface that will minimize the interference.

Figure 7:
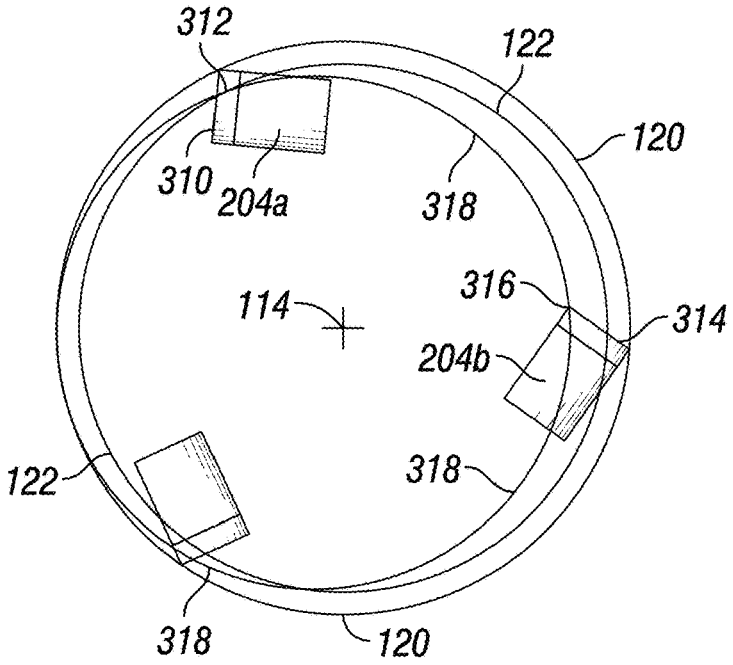
FIG. 7 is a bottom view of a drill bit.
Figure 7A:
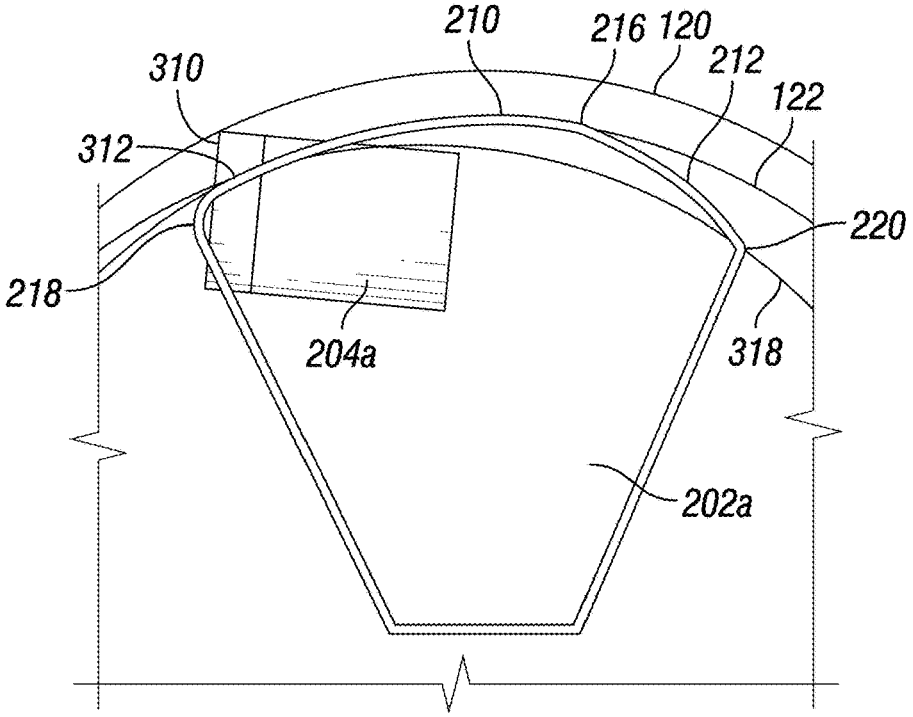
FIG. 7A is a detail view of a portion of FIG. 7.

Referring now to FIGS. 7 and 7A, the drill bit 102 may, in certain embodiments, comprises a first cutter 204*a* secured to a first blade 202*a*. The first blade 202*a* extends radially outward from the body of the drill bit 102 to a gauge diameter 122. The gauge diameter 122 is measured from the central axis 114 of the drill bit 102. The cutter 204*a* extends radially to a bit diameter 120. The bit diameter 120 is also measured relative to the central axis 114, but the bit diameter 120 is larger than the gauge diameter 122. The cutter 204*a* has a first cutting face 310 that intersects the gauge diameter 122 at a first point 312.

The drill bit 102 further comprises a second cutter 204*b* secured to a second blade. The second blade is adjacent the first blade 202*a*, and follows the first blade 202*a* when the bit is rotated. Similarly to the first blade 202*a*, the second blade extends radially outward from the body of the bit 102 to the gauge diameter 122. The second cutter 204*b* has a second cutting face 314 that extends radially between an innermost second point 316 on the second cutting face 314, and the bit diameter 120.

Like in previous embodiments, the first blade 202*a* is defined by the leading edge 218 and the trailing edge 220. The gauge surface 210 extending from the leading edge 218 of the first blade to the surface break 216 and the recessed surface 212 extends from the surface break 216 to the trailing edge 220 of the first blade. The surface break 216 is disposed at the gauge diameter 122. As shown in FIG. 7A, the gauge surface 210 is essentially located at the gauge diameter 122, but in other embodiments, the gauge surface 210 may be located at a distance that is less than the gauge diameter from the central axis of the drill bit, for example as illustrated in FIG. 6C.

To avoid contact between the trailing edge 220 and the wellbore wall, the recessed surface 212 is configured by drawing a circle 318 that passes through the first point 312 on the cutting face 310 of the first cutter 204*a*, passes through the second point 316 on the second face 314 of the second cutter 204*b*, and is tangent to the bit diameter 120. The circle 318 is in a plane perpendicular to the central axis 114 of the drill bit 102. The trailing edge 220 is partially located on or within the circle 318, that is, the intersection of the trailing edge with the plane perpendicular to the central axis 114 is on or within the circle 318. As shown in FIG. 7A, a distance from the central axis 114 to the recessed surface 212 decreases in a non-linear manner from the surface break 216 to the trailing edge 220. However, in other embodiments, the distance from the central axis 114 to the recessed surface 212 may decrease in a linear manner from the surface break 216 to the trailing edge 220.

The gauge surface 210 and the recessed surface 212 may be configured so that the gauge surface 210 provides full gauge contact when the drilling assembly is sliding through a wellbore and to minimize contact between the trailing edge 220 and the wellbore when the bit body is being rotated by the power section. For example, the surface break 216 may be located closer from the trailing edge 220 than from the leading edge 218, and the gauge surface 210 may be essentially located at the gauge diameter 122 (e.g., over 90% of the gauge surface 210 may be located at the gauge diameter).

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A drilling assembly comprising:

a drill bit coupled to a power section, the drill bit including a bit body having a central axis, the drill bit having a gauge diameter representing the outer diameter of the drill bit excluding any cutters measured relative to the central axis, and a bit diameter measured relative to the central axis, wherein the bit diameter is larger than the gauge diameter;

a first blade extending radially outward from the bit body to the gauge diameter, the first blade being defined by a leading edge and a trailing edge;

a second blade adjacent the first blade, the second blade extending radially outward from the bit body to the gauge diameter, a first cutter secured to the first blade, extending radially to the bit diameter, and having a first cutting face that intersects the gauge diameter at a first point;

a second cutter secured to the second blade, and having a second cutting face that extends radially between an innermost second point of the second cutting face and the bit diameter;

a gauge surface extending from the leading edge of the first blade to a surface break; and a recessed surface extending from the surface break to the trailing edge of the first blade, wherein the surface break is disposed at the gauge diameter, and wherein the trailing edge is partially located on or within a circle, the circle passing through the first point and the second point, and the circle being tangent to the bit diameter.

2. The drilling assembly of claim 1, wherein a distance from the central axis to the recessed surface decreases in a linear manner from the surface break to the trailing edge.

3. The drilling assembly of claim 1, wherein a distance from the central axis to the recessed surface decreases in a non-linear manner from the surface break to the trailing edge.

4. The drilling assembly of claim 1, wherein the gauge surface is at the gauge diameter.

5. The drilling assembly of claim 1, wherein the power section coupled to the bit body has a bent housing.

6. The drilling assembly of claim 5, wherein the gauge surface and the recessed surface are configured so that the gauge surface provides full gauge contact when the drilling assembly is sliding through a wellbore and to minimize interference between the trailing edge and the wellbore when the bit body is being rotated by the power section.

7. A drilling assembly comprising:

a power section coupled to a drill string, wherein the power section includes a bent housing;

a drill bit coupled to the power section, the drill bit including a bit body having a central axis;

a blade extending radially outward from the bit body and defined by a leading edge and a trailing edge;

a gauge surface extending from the leading edge to a surface break, wherein the gauge surface is disposed at a gauge diameter representing the outer diameter of the drill bit excluding any cutters measured relative to the central axis; and a recessed surface extending from the surface break to the trailing edge, wherein the recessed surface is configured by determining a range of contact in which cutters on the leading edge are in contact with a wellbore wall; determining the interference between the trailing edge of the blade and the wellbore wall; and determining the dimensions of the recessed surface necessary to avoid interference between the trailing edge and the wellbore wall.

8. The drilling assembly of claim 7, wherein the gauge surface and the recessed surface are configured so that the gauge surface provides full gauge contact when the drilling assembly is sliding through a wellbore and to minimize interference between the trailing edge and the wellbore when the bit body is being rotated by the power section.

9. The drilling assembly of claim 7, wherein a distance from the central axis to the recessed surface decreases in a linear manner from the surface break to the trailing edge.

10. The drilling assembly of claim 7, wherein a distance from the central axis to the recessed surface decreases in a non-linear manner from the surface break to the trailing edge.

11. The drilling assembly of claim 7, wherein the gauge surface is at the gauge diameter.

12. The drilling assembly of claim 7, further comprising a cutter disposed on the blade at the gauge diameter.

13. A method of designing a drill bit comprising:

selecting a bottom hole assembly including a drill bit having a blade and a bent housing having a bend angle, wherein the blade extends radially outward from the drill bit and is defined by a leading edge and a trailing edge and having cutters attached to the leading edge;

selecting a set of drill parameters including a wellbore having a wellbore wall;

evaluating the bottom hole assembly and the set of drill parameters to determine a range of contact for the drill bit during cutting operation of the wellbore wall by the cutters;

simulating the movement of the drill bit within the wellbore to determine if the blade interferes with the wellbore wall;

configuring a gauge surface extending from the leading edge to a surface break; and configuring a recessed surface extending from the surface break to the trailing edge, wherein the gauge surface and the recessed surface are configured so that the gauge surface provides contact between the blade and the wellbore wall when the drill bit is sliding through the wellbore and the recessed surface minimizes interference between the trailing edge and the wellbore wall when the drill bit is being rotated.

14. The method of claim 13, wherein the range of contact is determined using the bend angle of the bent housing.

15. The method of claim 14, wherein the movement of the drill bit is simulated using the rotational speed of the drill bit and the rotational speed of the bottom hole assembly.

16. The method of claim 13, wherein a distance from a central axis of the drill bit to the recessed surface decreases in a linear manner from the surface break to the trailing edge.

17. The method of claim 13, wherein a distance from a central axis of the drill bit to the recessed surface decreases in a non-linear manner from the surface break to the trailing edge.

18. The method of claim 13, wherein the surface break is at the same diameter as the leading edge.

19. The method of claim 13, wherein the drill bit further comprises a cutter disposed on the leading edge of the blade.

* * * * *